US010626866B2

(12) United States Patent
Ba et al.

(10) Patent No.: US 10,626,866 B2
(45) Date of Patent: Apr. 21, 2020

(54) METHOD TO IMPROVE DOWNHOLE MOTOR DURABILITY

(71) Applicant: Schlumberger Technology Corporation, Sugar Land, TX (US)

(72) Inventors: Samba Ba, Katy, TX (US); Peter T. Cariveau, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 277 days.

(21) Appl. No.: 15/537,640

(22) PCT Filed: Dec. 18, 2015

(86) PCT No.: PCT/US2015/066552

§ 371 (c)(1),
(2) Date: Jun. 19, 2017

(87) PCT Pub. No.: WO2016/106109

PCT Pub. Date: Jun. 30, 2016

(65) Prior Publication Data

US 2018/0003174 A1 Jan. 4, 2018

Related U.S. Application Data

(60) Provisional application No. 62/096,353, filed on Dec. 23, 2014.

(51) Int. Cl.
*F04C 2/107* (2006.01)

(52) U.S. Cl.
CPC ..... *F04C 2/1071* (2013.01); *F04C 2/1075* (2013.01); *F04C 2240/20* (2013.01); *F04C 2250/201* (2013.01); *F04C 2250/30* (2013.01)

(58) Field of Classification Search
CPC ..... F04C 2/1071; F04C 2240/20
See application file for complete search history.

(56) References Cited

U.S. PATENT DOCUMENTS

| | | | |
|---|---|---|---|
| RE21,374 | E | 2/1940 | Moineau |
| 3,975,120 | A | 8/1976 | Tschirky |
| 5,171,138 | A | 12/1992 | Orrest |
| 5,221,197 | A | 6/1993 | Kochnev et al. |
| 5,817,937 | A | 10/1998 | Beshoory et al. |

(Continued)

FOREIGN PATENT DOCUMENTS

| | | | |
|---|---|---|---|
| WO | 2005064114 | A1 | 7/2005 |
| WO | 2012122321 | A2 | 9/2012 |

OTHER PUBLICATIONS

International Search Report and Written Opinion issued in International Application PCT/US2015/066552 dated Mar. 22, 2016. 17 pages.

(Continued)

*Primary Examiner* — Mary Davis

(57) ABSTRACT

Rotor and/or stator designs and methods thereof to improve progressive cavity motor or pump durability. In one or more implementations, the rotor may have a variable outer diameter or variable stiffness along an axial length thereof. The stator may similarly have a variable inner diameter or variable stiffness, which may compliment or diverge from the variable outer diameter or variable stiffness of the rotor.

12 Claims, 3 Drawing Sheets

(56) References Cited

U.S. PATENT DOCUMENTS

| | | | | |
|---|---|---|---|---|
| 6,358,027 | B1 * | 3/2002 | Lane | F04C 2/1071 418/1 |
| 6,457,958 | B1 * | 10/2002 | Dunn | F04C 2/1071 418/1 |
| 9,869,126 | B2 * | 1/2018 | Evans | F04C 2/1071 |
| 10,227,978 | B2 * | 3/2019 | Sakakihara | F04C 2/107 |
| 2001/0005486 | A1 | 6/2001 | Wood | |
| 2006/0131079 | A1 | 6/2006 | Bottos | |
| 2008/0304991 | A1 | 12/2008 | Speckert | |
| 2011/0305589 | A1 * | 12/2011 | Daunheimer | F04C 2/1071 418/201.1 |
| 2012/0132470 | A1 | 5/2012 | Jarvis et al. | |
| 2013/0133950 | A1 | 5/2013 | Hohl et al. | |

OTHER PUBLICATIONS

International Preliminsary Report on Patentability issued in International Application PCT/US2015/066552 dated Jul. 6, 2017. 14 pages.

* cited by examiner

METHOD TO IMPROVE DOWNHOLE MOTOR DURABILITY

CROSS-REFERENCE TO RELATED APPLICATIONS

The present application claims the benefit of, and priority to, U.S. Provisional Patent Application No. 62/096,353, filed Dec. 23, 2014, which is hereby incorporated by reference in its entirety.

BACKGROUND

One or more implementations described herein generally relate to Moineau pumps and motors inclusive of positive displacement or progressive cavity motors and pumps. Such implementations that may be used when drilling the wellbore of a subterranean well. More particularly, one or more such implementations relate to designs and methods to improve the durability of such Moineau motors/pumps.

Wellbores are frequently drilled into the Earth's formation to recover deposits of hydrocarbons and other desirable materials trapped beneath the Earth's surface. A well may be drilled using a drill bit coupled to the lower end portion of what is known in the art as a drill string. The drill string has a plurality of joints of drill pipe that are coupled together end-to-end using threaded connections. The drill string is rotated by a rotary table or top drive at the surface, which may also rotate the coupled drill bit downhole. Drilling fluid or mud is pumped down through the bore of the drill string and exits through ports at or near the drill bit. The drilling fluid serves to both lubricate and cool the drill bit during drilling operations. The drilling fluid also returns cuttings to the surface via the annulus between the drill string and the side wall of the wellbore. At the surface, the drilling fluid is filtered to remove the cuttings.

A bottom hole assembly (BHA) is often disposed in drilling string toward the lower end portion thereof. The BHA is a collection of drilling tools and measurement devices and may include the drill bit, any directional or formation measurement tools, deviated drilling mechanisms, mud motors (e.g., Moineau pumps/motors) and weight collars. A measurement while drilling (MWD) or logging while drilling (LWD) collar is often positioned just above the drill bit to take measurements relating to the properties of the formation as the wellbore is being drilled. Measurements recorded from MWD and LWD systems may be transmitted to the surface in real-time using a variety of methods known to those skilled in the art. Once received, these measurements assist operators at the surface in making decisions relating to the drilling operation.

Directional drilling is the intentional deviation of the wellbore from the path that it would naturally take. In other words, directional drilling is the steering of the drill string so that the drill string travels in the desired direction. Directional drilling can be advantageous in offshore drilling because directional drilling permits several wellbores to be drilled from a single offshore drilling platform. Directional drilling also enables horizontal drilling through the formation, which permits a longer length of the wellbore to traverse the reservoir and may permit increased hydrocarbon production. Directional drilling may also be beneficial in drilling vertical wellbores. Often, the drill bit will veer off of an intended drilling trajectory due to the sometimes unpredictable nature of the underground formation and/or the forces the drill bit experiences. When such deviation occurs, a directional drilling system may be employed to return the drill bit to its intended drilling trajectory.

A common directional drilling system and its method of use employ a BHA that includes a bent housing and a Moineau motor/pump, which is also known as a positive displacement motor (PDM) or mud motor. The bent housing includes an upper section and lower section formed on the same section of drill pipe, but the respective sections are separated by a bend in the pipe. The bent housing with the drill bit coupled thereto is pointed in the desired drilling direction. The mud motor is employed to rotate the bent housing and thereby rotate the drill bit to drill in the desired direction.

A mud motor converts some of the energy from the flow of drilling fluid or mud downward through the bore of the drill string into a rotational motion that drives the drill bit. Thus, by maintaining the bent housing at the same azimuth relative to the borehole, the drill bit will drill in a desired direction. When straight drilling is desired, the entire drill string, including the bent housing, is rotated from the surface by the rotary table or top drive, as previously described. The drill bit may angulate with the bent housing and therefore may drill a slight overbore, but straight, wellbore.

PDM power sections include a rotor and a stator. The stator may be a metal tube, e.g., steel, with a rubber or elastomer molded and disposed to an inner surface thereof to form a multi-lobed, helixed interior profile. The stator tube may be cylindrical inside (having a rubber or elastomer insert of varying thickness), or may have a similar multi-lobed, helixed interior profile disposed therein so that the molded-in rubber/elastomer is of a substantially uniform thickness (i.e., even wall). Whether solid rubber/elastomer or even wall, power sections are generally uniform throughout their length. That is, they are either all rubber/elastomer or all even wall over the entire length of the multi-lobed, helixed interior profile. The rotor may also be constructed of a metal, such as steel, with a solid or hollow inner construction. The rotor may have a multi-lobed, helically-shaped outer surface, which compliments the inner surface of the stator. The rotor may also have a rubber or elastomer disposed on its outer surface. The outer surface of the rotor has one less lobe than the inner surface of the stator such that a moving, fluid-filled chamber is formed between the rotor and the stator as fluid is pumped through the motor.

The rotor rotates and gyrates in response to a fluid (e.g., drilling fluid or mud) pumped downhole through the drill string and stator of the PDM. The rubber or elastomeric materials within the motor, as discussed above, provide a seal between the rotor and the stator. Without this seal, the motor may operate inefficiently and/or fail altogether. Nevertheless, as the rotor turns or rotates within the stator, this rubber or elastomer can sustain undesirable lateral and shear forces between the rotor and the stator, which may lead to motor failure. Motor failure during directional drilling can be a significant and undesirable event. One mode of motor failure is rubber chunking in which one or more portions of the rubber or elastomer break off. Thus, there is a desire to reduce or eliminate the excessive lateral and shear forces sustained by the rubber or elastomer so as to improve motor durability and reduce motor failure.

SUMMARY

Described herein are implementations of various technologies for improving the durability and/or efficiency of a progressive cavity motor or pump. In one implementation, a progressive cavity motor or pump may include a stator with an internal axial bore therethrough. The internal axial bore has an inwardly facing surface with axial lobes to form a stator helical profile. The progressive cavity motor also has a rotor with an outer surface having axial lobes to form a rotor helical profile that is at least partially complimentary to the stator helical profile. The rotor is rotationally disposed within the internal axial bore of the stator. The axial lobes of the rotor number at least one less than the axial lobes of the stator to form a moving chamber between the rotor and stator. The rotor has a diameter that varies along an axial length thereof with the diameter of the rotor proximate an uphole end portion thereof being no greater than at a downhole end portion thereof.

In another implementation, a progressive cavity motor or pump may include a stator with an internal axial bore therethrough. The internal axial bore has an inwardly facing surface with axial lobes to form a stator helical profile. The progressive cavity motor also has a rotor with an outer surface having axial lobes to form a rotor helical profile that is at least partially complimentary to the stator helical profile. The rotor is rotationally disposed within the internal axial bore of the stator. The axial lobes of the rotor number at least one less than the axial lobes of the stator to form a moving chamber between the rotor and stator. The rotor has a variable stiffness along an axial length thereof. In one or more other implementations, the stator, rather than or in addition to the rotor, may have a variable stiffness along an axial length thereof. In some implementations, the rotor diameter proximate its downhole end portion may become increasingly less while the inner diameter of the stator proximate its downhole end portion may remain constant such that a variable fit occurs between the rotor and stator near their downhole end portions.

In yet another implementation, a method of increasing durability of a progressive cavity motor or pump is disclosed. The method involves providing a stator with an internal axial bore therethrough with the internal axial bore having an inwardly facing surface with axial lobes to form a stator helical profile. The method also provides a rotor with an outer surface having axial lobes to form a rotor helical profile that is at least partially complimentary to the stator helical profile. The rotor is rotationally disposed within the internal axial bore of the stator. The axial lobes of the rotor number at least one less than the axial lobes of the stator to form a moving chamber between the rotor and stator. Further, the rotor has a variable diameter along an axial length thereof. The method also involves varying rotor diameter along the axial length of the rotor to increase rotor stiffness toward a downhole end portion of the rotor.

The above referenced summary section is provided to introduce a selection of concepts in a simplified form that are further described below in the detailed description section. The summary is not intended to be used to limit the scope of the claimed subject matter. Furthermore, the claimed subject matter is not limited to implementations that solve disadvantages noted in any part of this disclosure.

BRIEF DESCRIPTION OF THE DRAWINGS

Implementations of various techniques will hereafter be described with reference to the accompanying drawings. It should be understood, however, that the accompanying drawings illustrate various implementations described herein and are not meant to limit the scope of various techniques described herein.

DETAILED DESCRIPTION

Figure 1:
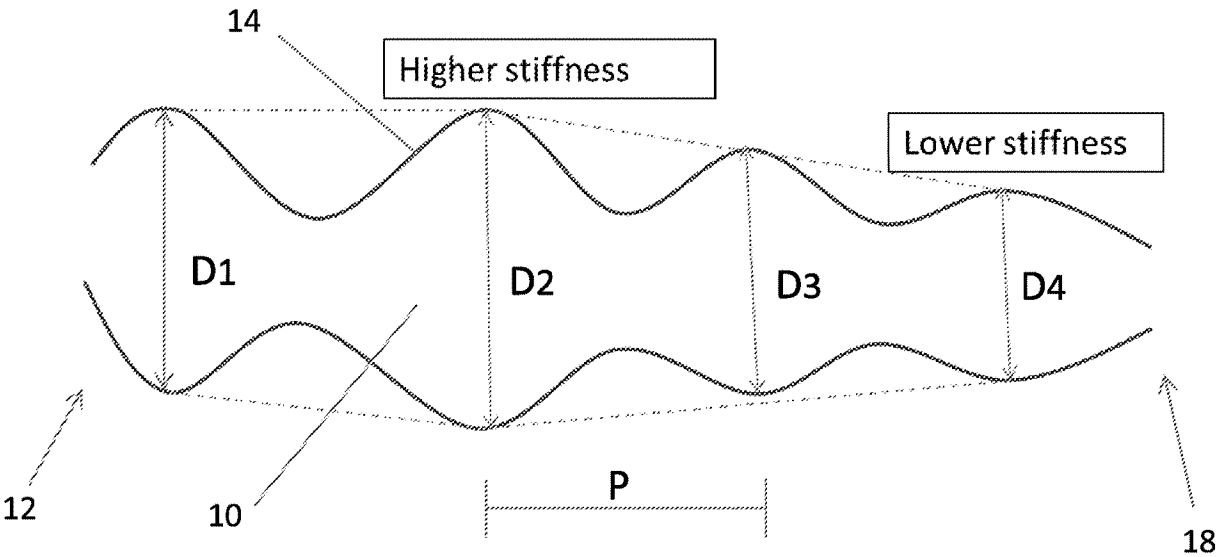
FIG. 1 illustrates an axial cross-sectional view of a rotor in accordance with one or more implementations disclosed herein in which rotor stiffness varies axially as a result of changing rotor diameter along its axial length.

The discussion below is directed to certain specific implementations. It is to be understood that the discussion below is for the purpose of enabling a person with ordinary skill in the art to make and use any subject matter defined now or later by the patent "claims" found in any issued patent herein.

It is specifically intended that the claims not be limited to the implementations and illustrations contained herein, but include modified forms of those implementations including portions of the implementations and combinations of elements of different implementations as come within the scope of the following claims.

Reference will now be made in detail to various implementations, examples of which are illustrated in the accompanying drawings and figures. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, components, apparatuses and systems have not been described in detail so as not to obscure aspects of the implementations.

It will also be understood that, although the terms first, second, etc. may be used herein to describe various elements, these elements should not be limited by these terms. These terms are used to distinguish one element from another. For example, a first object could be termed a second object, and, similarly, a second object could be termed a first object, without departing from the scope of the claims. The first object and the second object are both objects, respectively, but they are not to be considered the same object.

The terminology used in the description of the present disclosure herein is for the purpose of describing particular implementations and is not intended to be limiting of the present disclosure. As used in the description of the present disclosure and the appended claims, the singular forms "a,"

"an" and "the" are intended to include the plural forms as well, unless the context clearly indicates otherwise. It will also be understood that the term "and/or" as used herein refers to and encompasses one or more possible combinations of one or more of the associated listed items. It will be further understood that the terms "includes" and/or "including," when used in this specification, specify the presence of stated features, operations, elements, and/or components, but do not preclude the presence or addition of one or more other features, operations, elements, components and/or groups thereof.

As used herein, the terms "up" and "down"; "upper" and "lower"; "upwardly" and downwardly"; "below" and "above"; and other similar terms indicating relative positions above or below a given point or element may be used in connection with some implementations of various technologies described herein. However, when applied to equipment and methods for use in wells or boreholes that are deviated or horizontal, or when applied to equipment and methods that when arranged in a well or borehole are in a deviated or horizontal orientation, such terms may refer to a left to right, right to left, or other relationships as appropriate.

One or more implementations disclosed herein are directed to a Moineau-type motor or pump, also known as a progressive cavity motor or pump, having a rotor and/or stator arranged and designed to improve or increase durability. In one implementation, the rotor has a variable diameter along its axial length. The stator may also have a variable inner diameter that at least partially corresponds to the variable diameter of the rotor. In another implementation, the rotor has a variable stiffness along its axial length. Such variable stiffness may be attained by manipulating the minor and major diameters along the length of the rotor or by having axial portions of the rotor constructed of different materials, each with a different stiffness. Various implementations will now be disclosed in more detail with reference to FIGS. 1-6.

FIG. 1 illustrates an axial cross-sectional view of a rotor 10 in which rotor stiffness varies axially as a result of changing rotor diameter, e.g., $D_1$, $D_2$, $D_3$, $D_4$, along its axial length. The length between each labeled diameter, e.g., $D_1$, $D_2$, $D_3$, $D_4$, (labeled between $D_2$ and $D_3$ as "P") represents the pitch of the helix of the outer surface 14 of rotor 10. As shown, rotor 10 has an upper end portion 12 and a lower end portion 18. The upper end portion 12 rotationally couples directly or indirectly to a drill sting (not shown) or other downhole conveyance. The lower end portion 18 couples directly or indirectly to a drill bit (not shown). It is readily understood by those skilled in the art that the rotor 10 is rotationally disposed within the bore of a stator (not shown in FIG. 1 but see, e.g., FIG. 3) and that fluid flow downhole, and into a moving chamber (not shown) formed between the outer helical profile of the rotor 10 and inner helical profile of the stator of the motor power section, causes the rotor 10 to rotate within the stator. The rotor 10 may have varying minor and major diameters along the length of the rotor 10, i.e., through the power section of the motor. For example, $D_1$ is the diameter of rotor 10 proximate upper end portion 12 whereas $D_4$ is the diameter of the rotor 10 proximate lower end portion 18. As shown, the diameter of the rotor, $D_2$, intermediate the upper end portion 12 and the lower end portion 18, is greater than the diameter of the rotor, $D_4$, proximate the lower end portion 18. In one or more other implementations, disclosed hereinafter with reference to FIG. 4, the diameter of the rotor 10 at a point intermediate the upper end portion 12 and the lower end portion 18 may be less than the diameter of the rotor 10 at either the upper end portion 12 or the lower end portion 18, such, e.g., that $D_2$ and/or $D_3$ is less than $D_1$ and/or $D_4$.

Continuing with FIG. 1, these varying diameters provide different levels of rotor stiffness along the length of rotor 10. The various rotor diameters permit either greater or lesser amounts of bending of the rotor 10 while the rotor 10 rotates within the stator (not shown). A larger rotor diameter, e.g., the diameter at $D_2$, may equate to a lesser amount of rotor bending (i.e., greater stiffness) at that diameter and therefore may reduce the bending of the rotor 10 at desired positions, i.e., at $D_2$, along the axial length of the rotor 10, which may in turn reduce the shear stress on the elastomer of the stator and thereby increase stator durability. Conversely, a smaller rotor diameter, e.g., the diameter at $D_3$, may equate to a greater amount of rotor bending (i.e., lesser stiffness) at that diameter and therefore may increase bending of the rotor 10 at desired positions, e.g., at $D_3$, along the axial length of the rotor 10, which may in turn provide better sealing between rotor 10 and stator (not shown), e.g., at that axial position and thereby increase motor efficiency. Such variable stiffness of the rotor 10 along its axial length through the power section of the motor, as described above, may prolong the life or durability of the stator and/or rotor (e.g., the elastomer thereof) while simultaneously providing more or less the same torsional force. Thus, by optimally varying the stiffness of the rotor and/or stator along an axial length thereof, a stiffness profile may be attained which permits additional bending of the rotor and/or stator where needed to provide greater sealing and greater power, as well as permit less bending of the rotor and/or stator where needed to reduce the side load on the stator and provide greater durability to the stator and/or rotor (e.g., the elastomer thereof).

The bending stiffness, $K_r$, of the rotor is proportional to the fourth power of the outside (outer) diameter of the rotor, OD, minus the fourth power of the inside (inner) diameter of the rotor, ID, via the following equation:

$$K_r \alpha (OD^4 - ID^4)$$

In essence, this means that for a plain rotor with zero inside diameter, increasing the diameter by 10% along some axial portion thereof increases the bending stiffness by nearly 50%, which leads to nearly 50% less bending of the rotor along that increased diameter.

Figure 2:
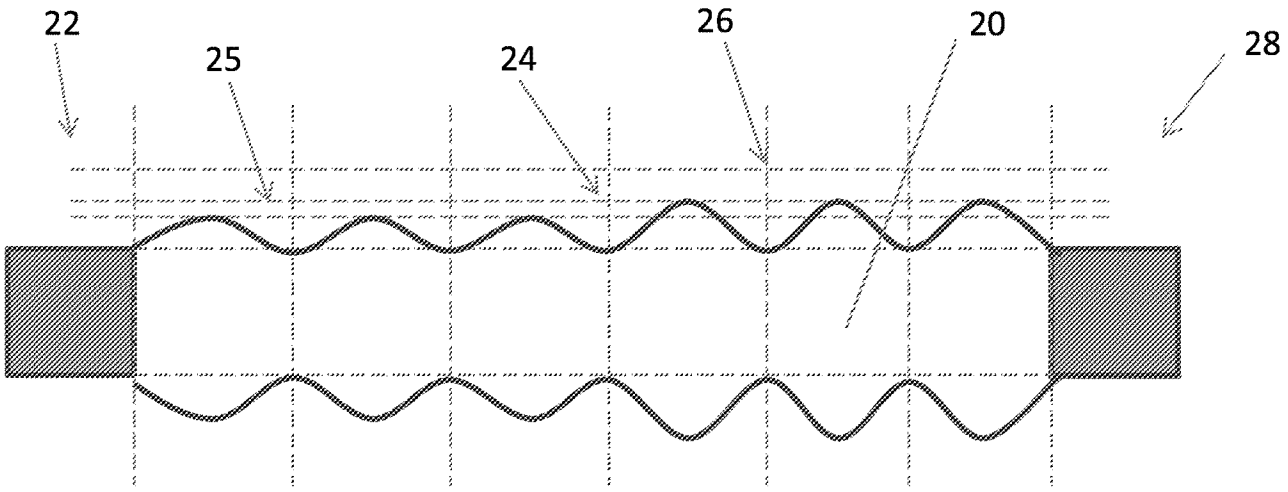
FIG. 2 illustrates an axial cross-sectional view of a rotor in accordance with one or more implementations disclosed herein in which the stiffness of the rotor varies axially by increasing the rotor diameter at a downhole end portion thereof.

Now turning to FIG. 2, another implementation is illustrated in which the diameter of the rotor 20 varies along its axial length. The rotor 20 has an upper end portion 22 and a lower end portion 28. As shown in FIG. 2, the diameter of the rotor 20 increases at about point 24 such that, from about the midpoint (at about point 24) of the rotor 20 to the lower end portion 28 of the rotor 20, the diameter of the rotor 20 is at a maximum as compared to the diameter of the rotor 20 uphole thereof (or proximate the upper end portion 22 thereof). The increased diameter of the rotor 20 proximate its lower end portion 28 increases the stiffness of the rotor 20 in its lower end portion 28 (as compared to the stiffness of the rotor 20 from about its midpoint at point 24 toward its upper end portion 22). While FIG. 2 shows that the increase in diameter of rotor 20 occurs near its midpoint (at about point 24), those skilled in the art will readily recognize that an increase in the diameter of rotor 20 may occur anywhere along an axial length thereof. As an example, the increase in diameter of the rotor 20 proximate its lower end portion 28 may start further uphole toward the upper end portion 22, e.g., near point 25, or further downhole toward the lower end portion 28, e.g., near point 26. Further, the axial length of any increase in rotor diameter is variable. In one or more implementations, the increased diameter of rotor 20 toward the lower end portion may have an axial length greater than one-half pitch, greater than three-fourths pitch, or even greater than one pitch of the rotor helical profile. As shown in FIG. 2, the axial length of the increased diameter of rotor 20 proximate its lower end portion 28 is about three pitch lengths.

While the rotor 20 of FIG. 2 is shown as having an increased outer diameter in the lower half of the rotor 20 (i.e., between about point 24 and the lower end portion 28), those skilled in the art will readily recognized that such diameter may instead be decreased relative to the diameter of the rotor 20 uphole thereof (e.g., from about point 24 toward the upper end portion 22). In such implementation, the rotor 20 of FIG. 2 would appear more like the rotor 10 of FIG. 1, with the diameter of the rotor 20 being smaller toward the lower end portion 28 than toward the upper end portion 22. Again, the axial length of any decrease in rotor diameter is variable. Although not shown, in one or more implementations, the decreased diameter of the rotor proximate its lower end portion may have an axial length greater than one-half pitch, greater than three-fourths pitch, or even greater than one pitch of the rotor helical profile.

Figure 3:
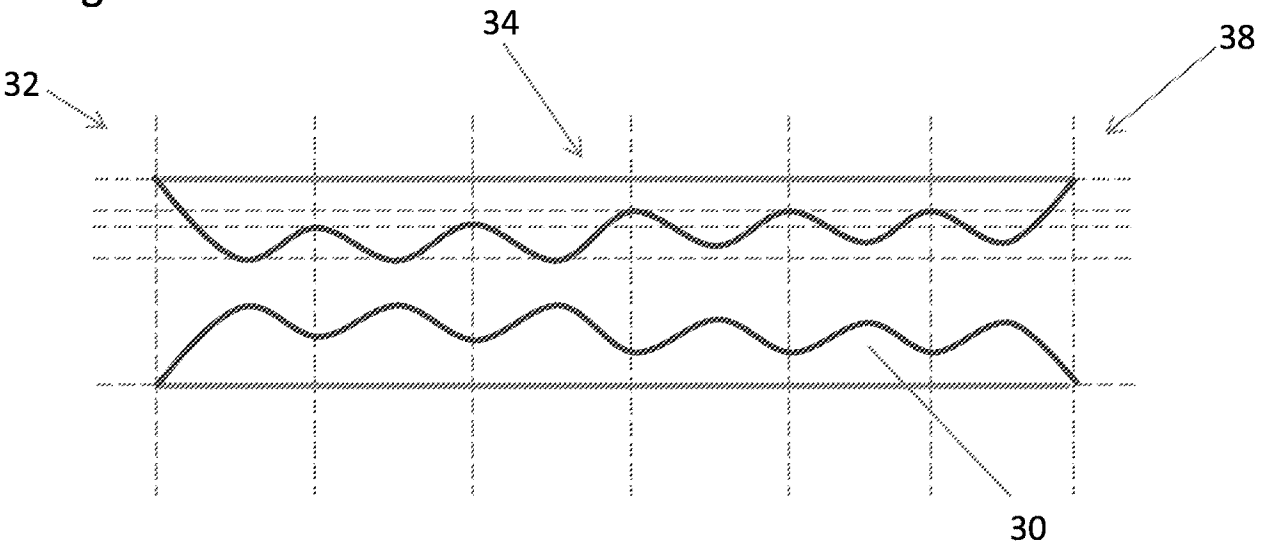
FIG. 3 illustrates an axial cross-sectional view of a stator in accordance with one or more implementations disclosed herein in which the stator has a helical profile that at least partially compliments the helical profile of the rotor of FIG. 2.

FIG. 3 illustrates a stator 30 having an upper end portion 32 and lower end portion 38. The stator 30 has an inner surface that at least partially corresponds to the outer surface of the rotor 20 of FIG. 2. As shown in FIG. 3, the stator 30 from about point 34 to its lower end portion 38 has an increased inner diameter (i.e., the diameter of the bore of the stator between its inner surfaces). This increased inner diameter corresponds to the increased diameter of rotor 20 of FIG. 2. The corresponding increase in inner surface diameter of stator 20 along with the increase in outer diameter of rotor 30 permit a constant or near constant fit between rotor and stator over the axial length of the increased respective diameters. As with the rotor 20 of FIG. 2, the stator 30 of FIG. 3 may have its inner surface diameter vary anywhere along an axial length thereof. The axial length of any increase in inner diameter of the stator may also vary similarly as discussed with respect to the rotor of FIG. 2. Thus, the increased inner diameter of the stator 30 may begin uphole or downhole of the point 34.

While the stator 30 of FIG. 3 is shown as having an increased inner diameter in the lower half of the stator 30 (i.e., between about point 34 and the lower end portion 38), those skilled in the art will readily recognized that such diameter may instead be decreased relative to the diameter of the stator 30 uphole thereof (e.g., from about point 34 toward the upper end portion 32). In such implementation, the stator 30 of FIG. 3 would appear more like a corresponding stator (not shown) for the rotor 10 of FIG. 1, with the inner diameter of the stator 30 being smaller toward the lower end portion 38 than toward the upper end portion 32. Again, the axial length of any decrease in stator inner diameter is variable. Although not shown, in one or more implementations, the decreased inner diameter of the stator proximate its lower end portion may have an axial length greater than one-half pitch, greater than three-fourths pitch, or even greater than one pitch of the stator helical profile.

The stator may incorporate a rigid stator form (e.g., a stator tube insert) or be an even wall stator construction to which a uniform thickness of an elastomer material is molded and applied to improve the sealing properties of the rotor/stator components while also stiffening the stator for transmission of increased torsional forces. Various examples of suitable stator construction are described in U.S. RE21374, U.S. Pat. Nos. 3,975,120, 5,171,138 A or U.S. Pat. No. 5,221,197.

Figure 4:
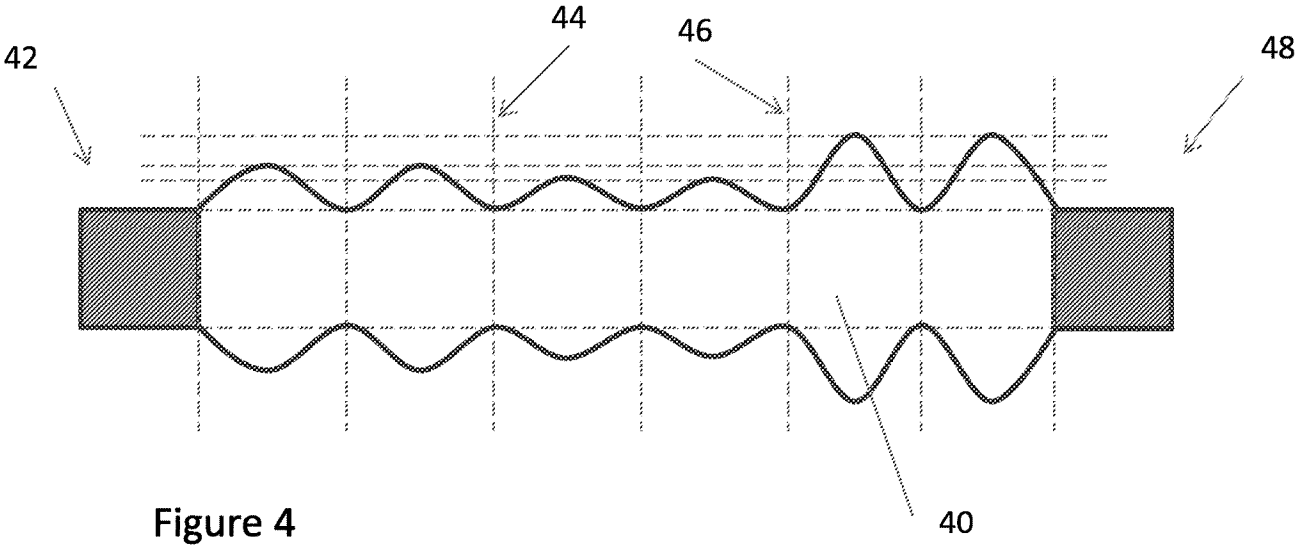
FIG. 4 illustrates an axial cross-sectional view of a rotor in accordance with one or more implementations disclosed herein in which the stiffness of the rotor varies axially such that a minimum rotor diameter occurs intermediate to an uphole end portion and a downhole end portion of the rotor.

FIG. 4 illustrates an additional implementation of a rotor 40 having an upper end portion 42 and a lower end portion 48. As shown in FIG. 4, moving downhole along the rotor 40 from its upper end portion 42, the outer diameter of the rotor 40 proximate the upper end portion 42 decreases at about point 44 such that a minimum outer diameter of the rotor 40 occurs proximate the midpoint of the rotor 40 (i.e., between about point 44 and about point 46 along the rotor 40). Continuing to move downhole along the rotor 40, the outer diameter of the rotor 40 increases at about point 46 to a maximum outer diameter. This maximum outer diameter continues to the lower end portion 48 of the rotor 40 such that the maximum outer diameter of the rotor 40 occurs proximate the lower end portion 48 of the rotor 40. As shown, this maximum outer diameter is greater that the diameter of the rotor 40 at the midpoint of the rotor 40 (i.e., between about point 44 and about point 46 of the rotor 40) and also the diameter of the rotor 40 proximate upper end portion 42 of the rotor 40.

The increased diameter of the rotor 40 proximate its lower end portion 48 increases the stiffness of the rotor 40 in its lower end portion 48 (as compared to the stiffness of the rotor 40 uphole thereof). Further, the increased diameter of the rotor 40 proximate its upper end portion 42 increases the stiffness of the rotor 40 in its upper end portion 42 (as compared to the stiffness of the rotor 40 proximate its midpoint or between about point 44 and about point 46 therealong). In this way, the diameter of the rotor 40 may be varied along the axial length of the rotor to concentrate a lower stiffness of the rotor towards or proximate a midpoint (between about point 44 and about point 46) of the rotor 40. Such a stiffness profile permits the middle portion of the rotor 40 to bend and/or flex to a greater extent than the end portions 42, 48 thereof.

While points 44 and 46 are shown on FIG. 4 as being at about one-third and two-thirds, respectively, of the axial length of the rotor 40, those skilled in the art will readily recognize the relative axial lengths of the various increases or decreases in the outer diameter of the rotor may have any desired axial length. In one or more implementations, the maximum diameter of rotor 40 toward the lower end portion 48 may have an axial length greater than one-half pitch, greater than three-fourths pitch, or even greater than one pitch of the rotor helical profile. As shown in FIG. 4, the axial length of the maximum diameter of rotor 40 proximate its lower end portion 88 is about two pitch lengths.

Furthermore, with any of the various implementations disclosed herein, such desired axial length of the rotor diameter increases and/or decreases may be selected so as to concentrate regions of stiffness or flexibility into the rotor. In this way, additional bending of the rotor and/or stator is permitted where needed to provide greater sealing (and greater power) as well as less bending of the rotor and/or stator where needed to reduce the side load on the stator and provide greater durability to the stator and/or rotor (and the elastomer thereof).

Returning to FIG. 4, while a stator is not shown that has an inner surface helical profile that corresponds to the outer surface helical profile with varied outer diameters of rotor 40, those skilled in the art will readily appreciate that a stator may be designed to have an inner surface stator profile with inner diameters to at least partially correspond to the outer surface rotor profile with varied outer diameters.

One implication of the variable stiffness rotor is that it also allows the rotor to have a variable fit with the stator as desired. For example, the rotor 10 of FIG. 1 may have its outer diameter proximate its lower end portion 18 reduced as shown while the inner diameter of the corresponding portion of stator is not reduced. In such case, a variable fit or taper occurs between the rotor and stator proximate their respective lower end portions. However, as discussed above, it is well possible to adjust the stator inner diameter and thus rotor/stator fit along the axial length of the power section (i.e., between the rotor and stator) to maintain the exact same or similar fit all along the length thereof regardless of the desired outer diameter profile of the rotor.

Figure 5:
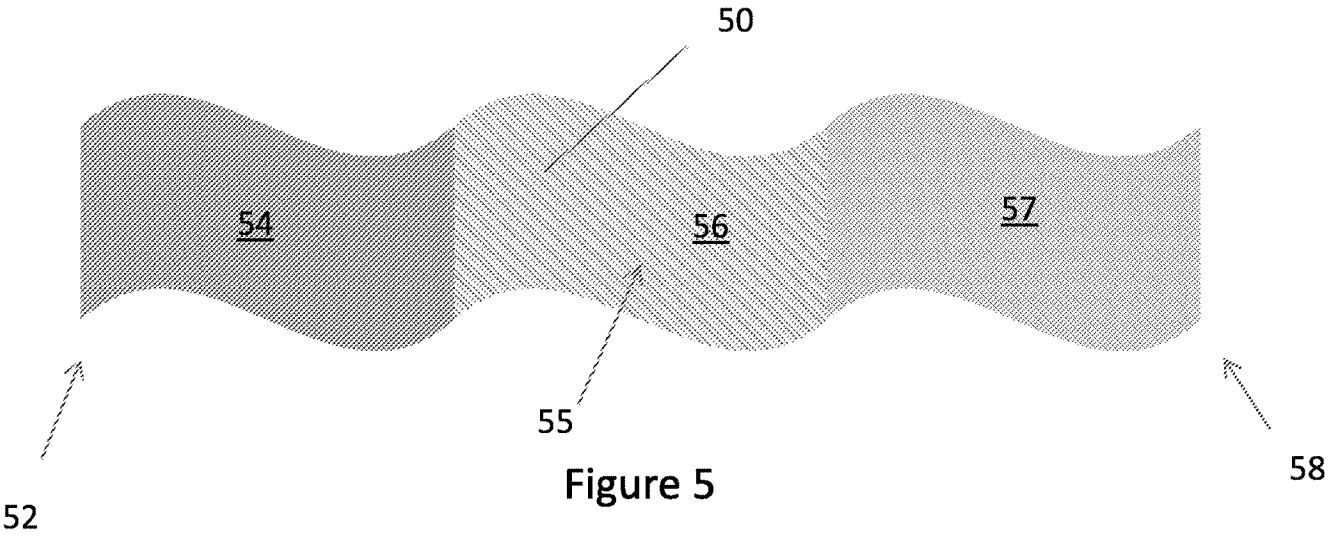
FIG. 5 illustrates an axial cross-sectional view of a rotor in accordance with one or more implementations disclosed herein in which stiffness of the rotor varies axially as a result of the rotor being composed of one or more different materials along its axial length.

FIG. 5 is an example of a rotor 50 with an upper end portion 52, a lower end portion 58 and a middle portion 55 along its axial length with each portion composed of different materials 54, 56, 57. Because the bending stiffness, $K_r$, of the rotor is also directly proportional to the Young's modulus, the materials of construction along the axial length of the rotor may be changed to different materials that have greater stiffness or lesser stiffness depending the desired stiffness along the rotor at that axial position. In this way, a non-varying outer diameter of the rotor and a corresponding inner diameter of the stator may be maintained along the entirety of the power section while the stiffness of the rotor and/or stator is nevertheless varied therealong.

Figure 6:
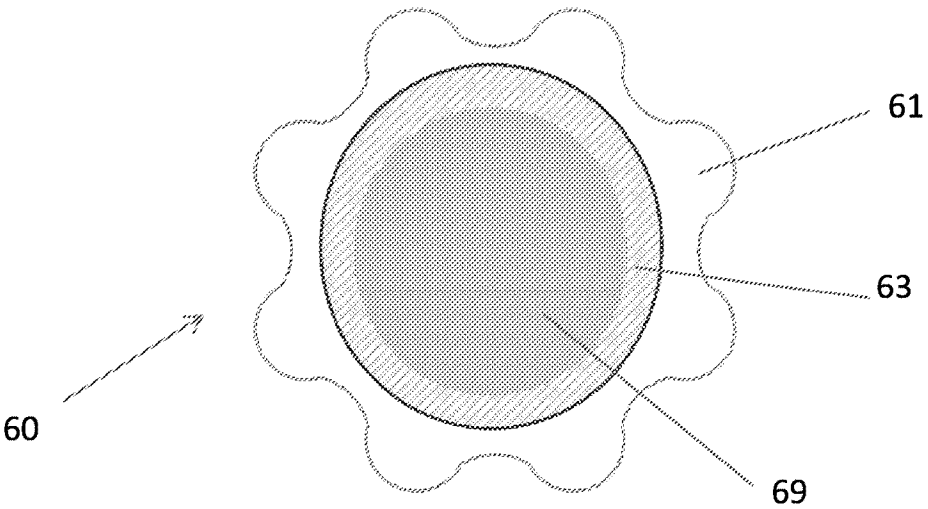
FIG. 6 illustrates a radial cross-sectional view of a rotor in accordance with one or more implementations disclosed herein in which stiffness of the rotor may vary axially as a result of the rotor being composed of one or more different materials along its radial length.

FIG. 6 illustrates the cross-section of a rotor 60 which is constructed of several materials 61, 63, 69, which may contribute varying stiffness to the rotor 60. This cross-section, shown in FIG. 6, may be a cross-section, for example, of any one of the rotor portions 54, 56, or 57 of FIG. 5. Each of the materials 61, 63, 69 may be selected so as to impart a certain stiffness. The combination of materials and their radial arrangement provide a unified stiffness. Materials 61, 63, 69 are selected such that one or more will be much stiffer than others. Materials 61, 63, 69 may be any suitable materials known to those skilled in the art and may include, without limitation, various metals (e.g., various steels), plastics, elastomers, fabrics, textiles, cellulosic materials, etc. While three materials 61, 63, 69 are shown in FIG. 6, it will be appreciated that any number of materials may be used.

Although only a few example implementations have been described in detail above, those skilled in the art will readily appreciate that many modifications are possible in the example implementations without materially departing from "Design and Method to Improve Downhole Motor Durability." Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of the any of the claims herein, except for those in which the claim expressly uses the words 'means for' together with an associated function.

What is claimed is:

1. A progressive cavity motor or pump, comprising:

a stator with an internal axial bore therethrough, the internal axial bore having an inwardly facing surface with axial lobes arranged and designed to form a stator helical profile; and a rotor with an outer surface having axial lobes arranged and designed to form a rotor helical profile that is at least partially complimentary to the stator helical profile; the rotor being rotationally disposed within the internal axial bore of the stator; the axial lobes of the rotor numbering at least one less than the axial lobes of the stator to form a moving chamber between the rotor and the stator; the rotor having a diameter that varies along an axial length thereof, the diameter of the rotor proximate an uphole end portion thereof being no greater than at a downhole end portion thereof; and the diameter of the rotor intermediate the uphole end portion and the downhole end portion is a minimum diameter.

2. The progressive cavity motor or pump of claim 1 wherein the diameter of the rotor proximate the downhole end portion thereof is greater than at an uphole diameter.

3. The progressive cavity motor or pump of claim 1, wherein rotor stiffness proximate the minimum diameter is less than elsewhere along the axial length of the rotor.

4. The progressive cavity motor or pump of claim 1, wherein the rotor is constructed of the same materials at the uphole end portion as at the downhole end portion.

5. The progressive cavity motor or pump of claim 1 wherein the stator has an inner diameter that varies to complement the diameter of the rotor.

6. A progressive cavity motor or pump, comprising:

a stator with an internal axial bore therethrough, the internal axial bore having an inwardly facing surface with axial lobes arranged and designed to form a stator helical profile; and a rotor with an outer surface having axial lobes arranged and designed to form a rotor helical profile that is at least partially complimentary to the stator helical profile; the rotor being rotationally disposed within the internal axial bore of the stator; the axial lobes of the rotor numbering at least one less than the axial lobes of the stator to form a moving chamber between the rotor and the stator; the rotor having a variable stiffness along an axial length thereof and the rotor has a diameter intermediate an uphole end portion and a downhole end portion that is a minimum diameter such that rotor stiffness proximate the minimum diameter is less than elsewhere along the axial length of the rotor.

7. The progressive cavity motor or pump of claim 6 wherein the stator has an inner diameter that varies to complement the diameter of the rotor.

8. The progressive cavity motor or pump of claim 6, wherein the rotor is constructed of the same materials at an uphole end portion as at a downhole end portion.

9. The progressive cavity motor or pump of claim 6 wherein rotor stiffness at a downhole end portion is no less than rotor stiffness uphole thereof.

10. The progressive cavity motor or pump of claim 9 wherein the downhole end portion has an axial length greater than one half pitch.

11. A method of increasing durability of a progressive cavity motor or pump, the method comprising:

providing a stator with an internal axial bore therethrough, the internal axial bore having an inwardly facing surface with axial lobes arranged and designed to form a stator helical profile;

providing a rotor with an outer surface having axial lobes arranged and designed to form a rotor helical profile that is at least partially complimentary to the stator helical profile; the rotor being rotationally disposed within the internal axial bore of the stator; the axial lobes of the rotor numbering at least one less than the axial lobes of the stator to form a moving chamber between the rotor and the stator; the rotor having a variable diameter along an axial length thereof; and varying rotor diameter along the axial length of the rotor to increase rotor stiffness toward a downhole end portion of the rotor; wherein the rotor diameter intermediate an uphole end portion of the rotor and the downhole end portion of the rotor is a minimum diameter.

12. The method of claim 11, further comprising:

varying stator inner diameter to complement the variable diameter of the rotor.

* * * * *